United States Patent [19]

Bücking et al.

[11] Patent Number: 4,832,106

[45] Date of Patent: May 23, 1989

[54] PRODUCTION OF CASTINGS CONTAINING STEEL TUBES

[75] Inventors: Heinz L. Bücking; Christoph Knoche; Wilhelm Sieweke, all of Dortmund, Fed. Rep. of Germany

[73] Assignee: Hoesch Werke Aktiengesellschaft, Dortmund, Fed. Rep. of Germany

[21] Appl. No.: 402,300

[22] Filed: Jul. 27, 1982

Related U.S. Application Data

[63] Continuation-in-part of Ser. No. 401,381, Jul. 23, 1982, abandoned.

[30] Foreign Application Priority Data

Jul. 25, 1981 [DE] Fed. Rep. of Germany ..... 3129391

[51] Int. Cl.[4] ..... B22D 19/00

[52] U.S. Cl. ..... 164/98; 164/100

[58] Field of Search ..... 164/98, 100

[56] References Cited

U.S. PATENT DOCUMENTS

| | | | |
|---|---|---|---|
| 4,335,870 | 6/1982 | Diener et al. | 266/193 |
| 4,344,477 | 8/1982 | Miki et al. | 164/98 |

FOREIGN PATENT DOCUMENTS

| | | | |
|---|---|---|---|
| 2804544 | 8/1979 | Fed. Rep. of Germany | 164/100 |
| 2903104 | 7/1980 | Fed. Rep. of Germany . | |
| 32426 | 3/1976 | Japan | 164/100 |
| 595067 | 2/1978 | U.S.S.R. | 164/127 |

OTHER PUBLICATIONS

Kirk-Othmer Encyclopedia of Chemical Technology, 2nd Ed, vol. 17, "Radioactive Drugs & Tracers to Semi--conductors", pp. 243-245.

*Primary Examiner*—Richard K. Seidel
*Attorney, Agent, or Firm*—Horst M. Kasper

[57] ABSTRACT

The invention provides a method and a set-up for production of castings containing cast-in steel tubes, preferably to provide cooling elements for metallurgical furnaces. The castings are from cast steel and the steel tubes are cast-in with a superheated cast steel melt. Before the casting the tubes are filled with a granular, highly thermal conductive, refractory material. In order to assure that the cast-in steel or respectively cooling tubes remain free from leaks, the invention provides to employ as a filling material one or more of the materials: burned magnesite (sintered magnesite), corundum, sintered aluminum oxide, chromite, silicon carbide, silicon nitride.

10 Claims, 1 Drawing Sheet

FIG. 1
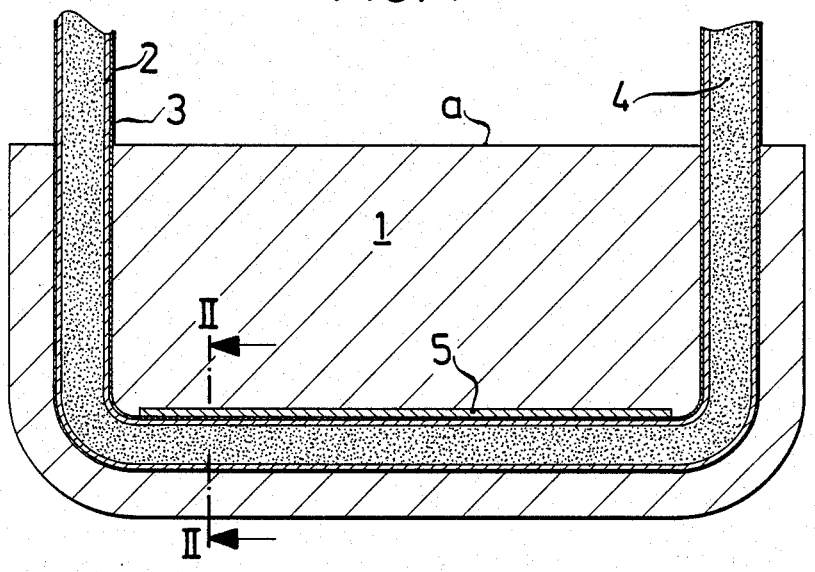
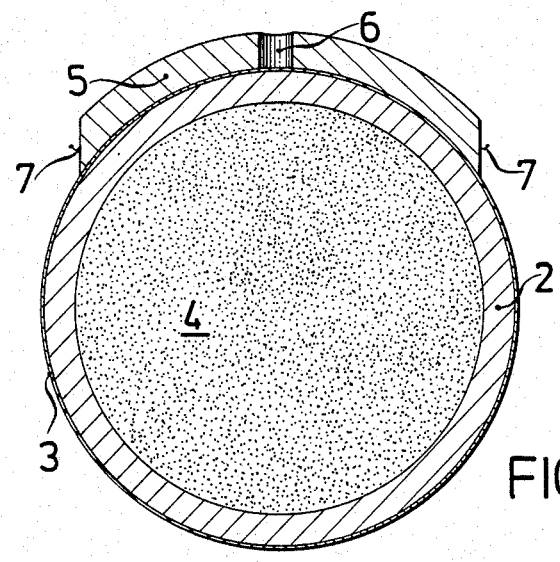
FIG. 2

PRODUCTION OF CASTINGS CONTAINING STEEL TUBES

DESCRIPTION

This application is a continuation-in-part of Ser. No. 401,381, filed July 23, 1982, now abandoned.

BACKGROUND OF THE INVENTION

1. Field of the Invention

The present invention relates to a method for production of castings containing cast-in tubes from steel, where the castings comprise cast steel and where the steel tubes are cast-in with a superheated melt of cast steel and where the steel tubes are filled with a granular, highly thermal conductive, refractory material before the casting step.

2. Brief Description of the Background of the Invention Including Prior Art

Methods for production of castings containing cast-in tubes from steel are known for example used as cooling elements for the walls of metallurgical furnaces such as blast furnaces. Usually grey cast iron with varying graphite formation is used as a casting material for the cooling elements. The material for production of the cooling tubes has a defined steel composition depending on the function (compare German Patent Laid-open DES-AS No. 27 19 165, DE-No. 30 13 560, A 1). Based on the various liquidus temperatures of grey cast iron and of steel tube material no substantial problems of casting technique are encountered when casting around such steel tubes with grey cast iron. The steel tubes to be surrounded by cast material usually do not need a material to fill the tubes during casting, however, at any rate they are to be protected against carburization on the outside by a suitable covering.

However, if, instead of grey cast iron, cast steel is employed as the casting material to surround the steel tubes as described in German Laid-open Document DE-OS No. 2903104 for a cooling element for a metallurgical furnace, then there result substantial problems of casting technique and metallurgical problems for the casting around of tubes of steel. For elimination of these problems it is proposed in the above document DE-OS No. 2903104 to dispose bodies from steel or cast steel between the cooling tubes, which are to accept the super-heating heat of the liquid cast steel. In addition, the cooling tubes according to the state of the art are to be filled with a high melting, highly thermal conductive and granular material before casting around with cast steel. Zirconia and chromium oxide or a mixture of these materials are recited as materials suitable for this purpose. However, if cooling elements are produced according to this known method, then part of the cast-in tubes for guiding cooling liquid have leaks. In addition, the recited materials for filling the tubes are relatively expensive.

SUMMARY OF THE INVENTION

1. Purposes of the Invention

It is an object of the present invention to provide a method for casting steel around steel tubes which avoids the disadvantages of the known method.

It is another object of the present invention to provide a method for casting steel around steel tubes resulting in steel tubes which are leak tight.

It is a further object of the invention to provide a method for producing cooling elements from steel for metallurgical furnaces such as blast furnaces.

These and other objects and advantages of the present invention will become evident from the description which follows.

2. Brief Description of the Invention

The present invention provides according to one aspect a method for the production of steel castings incorporating steel tubes, which comprises disposing the steel tubes filled with a member of the group consisting of magnesium oxide, aluminum oxide, corundum, sintered aluminum oxide, chromite, silicon carbide, silicon nitride, and mixtures thereof in a mold and casting superheated steel melt into the mold around the steel tubes.

The material in the steel tubes can be a granular, highly thermal conductive and refractory material. The steel tubes are preferably filled with a mixture of granular burned magnesite with up to 30 weight percent of at least one additional material or with a mixture of technically pure silicon carbide SiC and silicon nitride $Si_3N_4$ in a desired mixing ratio. The magnesium oxide can be burned magnesite with at least about 75 weight percent magnesium oxide and preferably at least 90 weight percent magnesium oxide, the chromite can contain at least about 30 weight percent chromium sesquioxide and preferably at least about 40 weight percent of chromium sesquioxide, and the corundum and the sintered aluminum oxide can contain at least about 90 weight percent of aluminum oxide and preferably at least about 95 weight percent of aluminum oxide. The corresponding typical impurities of the natural or synthetic materials should be low for example for $SiO_2$, $Al_2O_3$, CaO, MgO, $Fe_2O_3$, FeO.

All percentages set forth in the present application as to material composition are by weight unless otherwise specified.

The grain size of the material filled into the steel tubes can be from about 0 to 3 millimeter and is preferably from about 0 to 1 millimeter. The steel tube filling can comprise additional materials including organic and/or inorganic disperging, liquefying, plasticizing means and binders as well as other chemical means with similar effects. Steel tubing pieces can be disposed on the steel tubes closely spaced before the casting such that only a small airgap remains between the steel tube surface and the steel tubing pieces.

There is further provided in one aspect of the invention a method for production of steel castings incorporating steel tubes, where the steel tubes are disposed in a mold, tubing pieces are matched closely to the surface of the steel tubes resulting in a minimal air gap between the steel tube surface and the tubing pieces, and a superheated steel melt is cast around the steel tubes and the steel tubing pieces. The steel tubing pieces can be tubing segments or tubing shells. Preferably from about one third to one half of the steel tube surface is covered by the steel tubing pieces before casting and the steel tubing pieces are positioned on the upper side of the cast in steel tubes only in direction toward the riser (feeder head). The wall thickness of the steel tubing pieces to be positioned on the steel tubes can be from about one half to three times the wall thickness of the steel tubes. The steel tubing pieces can be provided with bore holes and/or inclined bevels. Preferably, the steel tube is filled with a granular, highly thermal conductive, refractory material.

Advantageously, the granular material for filling the steel tubes is provided with an as dense as possible packing of spheres, that is a minimal part of hollow space is present, based on its grain size distribution, since otherwise the high degree of thermal conductivity of the materials employed according to the invention would be noticeably reduced. For this purpose the grain size of the material can be 0 to 3 millimeter and preferably 0 to 1 millimeter.

In order to achieve a good density of the filling material for the steel tubes in a dry or moist to liquid state there is desirable besides the grain size distribution means the addition of means positively influencing the capability of flowing such as they are also employed in the heavy clay industry and in fine ceramics. Therefor, the filling material for the tubes can include dispersing agents, liquefying agents, plasticizers, binders and other chemical additives showing similar effects.

The invention method provides in particular the advantages that now continuously non-leaking cooling tubes are retained since the tube filling material filled into the tubes hardly shrinks or sinters at the prevailing casting temperature for unalloyed to highly alloyed cast steel, which temperature is usually 20 to 100 degrees centigrade above the liquidus temperature. Furthermore, the grain properties allow a good densification and do not or only insubstantially result in a decarburization or carburization of the material of the steel tubes. In particular, the filling material for the tubes should not or only to such minor degree be susceptible to chemical reduction or carburization at the high temperatures in the environment of the steel tubes as to avoid the loss of carbon or respectively cause oxidation and/or decomposition at the steel tube. Thus the present invention provides for reliably casting steel around steel tubes and without the danger of leaks resulting.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing in which is shown one of the various possible embodiments of the present invention:

FIG. 1 is a sectional elevation view of a steel tube disposed in a steel casting; and FIG. 2 is a cross-sectional view of the steel tube together with a steel tubing piece along section line II—II of FIG. 1 at an enlarged scale.

DESCRIPTION OF INVENTION AND PREFERRED EMBODIMENTS

In accordance with the present invention there is provided a method for the production of castings with incorporated tubes from steel, preferably of cooling elements for a metallurgical furnace, where the castings are from cast steel and where the steel tubes are cast-in with a superheated steel melt and where the tubes are filled with a granular, highly thermal conductive, refractory material, where the granular material employed comprises one or more of the following: burned magnesite (sintered magnesite), corundum, sintered alumina, chromite, SiC, $Si_3N_4$.

The granular material can comprise burned magnesite with up to about 30 weight percent of an addition of one or more granular materials. A desired ratio of mixing of technically pure silicon carbide and silicon nitride can be employed for filling the steel tubes. The burned magnesite can preferably contain at least 75 weight percent MgO, preferably at least 90 weight percent MgO, the chromite can comprise at least 30 weight percent $Cr_2O_3$, and preferably at least 40 weight percent $Cr_2O_3$, and the corundum and sintered alumina can comprise more than 90 weight percent.

$Al_2O_3$, and preferably more than 95 weight percent $Al_2O_3$. The natural or synthetic materials can comprise a residue of typical impurities in as small an amount as possible, for example silicon dioxide, aluminum oxide, calcium oxide, magnesium oxide, ferrous/ferric oxide.

Furthermore, there is provided a method for production of castings with cast-in tubes from steel, preferably as cooling elements for a metallurgical furnace, where the castings comprise cast steel and where the steel tubes are cast in a superheated melt of cast steel, where the steel tubes to be cast-in are provided with tube segments or tube shells disposed closely spaced to the tube surface such that only a minimal air gap remains between the steel tube surface and the steel tubing segments or shells. Advantageously holes are provided in the tubing segments or shells as well as bevelled edges for inducing an optimal removal of casting gas and they alleviate the formation of a narrow air gap between the steel tube to be cast in and the steel tubing segments or shells superposed. The material quality of the steel tubing segments or steel tubing shells is relatively unimportant.

The composition of the steel melts for casting employed in the method of the present invention can vary depending on the purpose of application within the limits given below, since in addition to unalloyed also highly alloyed cast steel can be employed, for example for thermally stable and/or non-scaling cast parts. The composition ranges preferred are:

0.10–0.50% C
0.30–2.00% Si
0.60–2.00% Mn
0–12.00% Ni
0–12.00% Cr
0–1.50% Mo
0–0.70% V
0–1.00% Al
0.03% S
0.03% P

The remainder comprises iron and unavoidable impurities.

The steel tubes preferably can have a composition with less than about 0.17 weight percent carbon, less than about 0.35 weight percent silicon, less than about 0.04 weight percent sulfur, less than about 0.04 weight percent phosphorus and between 0.40–0.80 weight percent manganese. Preferably, the tubes are free from surface defects, blow holes and cracks.

Referring now to FIG. 1 there is shown a casting 1 into which a steel tube 2 is embedded, which had been coated with a thin surface layer 3 (FIG. 2) such as from for example alumina. The steel tube is densely filled with a sintered magnesite 4 of a grain size from 0 to 0.5 millimeter diameter. The following table shows the chemical composition and the grains size distribution of the sintered magnesite.

Chemical Composition $SiO_2$: 0.8%; $Al_2O_3$: 0.3%
$Fe_2O_3$: 0.2%; CaO: 2.3%
MgO: 96%

Grain Size Distribution 0.5–0.25 millimeter 23%
0.25–0.12 millimeter 27%
0.12–0 millimeter 50%

The casting 1 surrounding the steel tube 2 has the following chemical composition:

| C | Si | Mn | P | S | Al | Balance |
|---|---|---|---|---|---|---|
| 0.25 | 0.45 | 0.85 | 0.020 | 0.020 | 0.030 | Fe |

The casting temperature is from about 1520 to 1550 degrees centigrade. The steel tubes corresponds to the material specified as St 35.8/II according to German Industrial Standard DIN 17175. The steel tube correspondingly comprises up to about 0.17 weight percent carbon, up to about 0.35 weight percent silicon, up to about 0.04 weight percent phosphorus, up to about 0.04 weight percent sulfur, and at least about 0.40 and 0.80 weight percent manganese.

FIG. 2 shows in detail the steel tube 2 to be cast-in with its about 50 to 200 micrometer thick coating 3 of a refractory material such as aluminum oxide, the tube filling material 4 and a positioned steel tubing shell 5, which is provided with the bore holes 6 and bevels at the edges 7. The steel tubing shell 5 covers about one third of the circumference of the steel tube 2 and is disposed on the with "a" designated side which is the riser side of the casting as is shown in FIG. 1. The thickness of the wall of the steel tubing shell 5 according to the preferred embodiment corresponds approximately to the thickness of the wall of the steel tube to be cast-in.

It will be understood that each of the elements described above, or two or more together, may also find a useful application in other types of casting configurations and metallurgical procedures differing from the types described above.

While the invention has been illustrated and described in the context of a method and a provision for production of steel castings incorporating steel tubes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. The method for production of steel castings incorporating steel tubes comprising disposing the steel tubes filled with a composition including magnesium oxide in a mold; placing on the surface of the steel tubes tubing pieces of steel such that only a minimal air gap remains between the steel tube surface and the steel tubing pieces; and casting superheated steel melt into the mold around the steel tubes.

2. A method for production of steel castings incorporating steel tubes comprising disposing steel tubes in a mold; placing closely surface matched tubing pieces onto the steel tubes resulting in a minimal air gap between the steel tubes surface and the tubing pieces; and casting a superheated steel melt around the steel tubes and steel tubing pieces.

3. The method for production of steel castings according to claim 2 wherein the steel tubing pieces are tube segments.

4. The method for production of steel castings according to claim 2 wherein the steel tubing pieces are tube shells.

5. The method for production of steel castings according to claim 2 wherein the steel tubing pieces cover only from about one third to one half of the steel tube surface.

6. The method for production of steel castings according to claim 2 wherein the steel tubing pieces are positioned only on the upper surface of the cast in steel tube and only in direction toward the riser (feeder head).

7. The method for production of steel castings according to claim 2 wherein the wall thickness of the steel tubing pieces to be positioned on the steel tubes is from about one half to three times the wall thickness of the steel tubes.

8. The method for production of steel castings according to claim 2 wherein the steel tubing pieces are provided with bore holes and inclined bevels.

9. The method for production of steel castings according to claim 2 wherein the steel tube are filled with a granular, highly thermal conductive, refractory material.

10. The method for production of steel castings according to claim 2 wherein the steel tubes are filled with a composition containing substantial amounts of magnesium oxide.

* * * * *